US011002479B2

(12) United States Patent
Rehage et al.

(10) Patent No.: US 11,002,479 B2
(45) Date of Patent: May 11, 2021

(54) STORAGE SHELF BASE AND ITEM OF FURNITURE OR HOUSEHOLD APPLIANCE

(71) Applicant: PAUL HETTICH GMBH & CO. KG, Kirchlengern (DE)

(72) Inventors: Daniel Rehage, Chemnitz (DE); Andreas Matthes, Chemnitz (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 16/642,524

(22) PCT Filed: Aug. 27, 2018

(86) PCT No.: PCT/EP2018/072994

§ 371 (c)(1),
(2) Date: Feb. 27, 2020

(87) PCT Pub. No.: WO2019/042923

PCT Pub. Date: Mar. 7, 2019

(65) Prior Publication Data

US 2020/0191471 A1 Jun. 18, 2020

(30) Foreign Application Priority Data

Sep. 1, 2017 (DE) ..... 10 2017 120 159.9

(51) Int. Cl.
*F25D 25/02* (2006.01)
*A47B 96/07* (2006.01)

(52) U.S. Cl.
CPC ..... *F25D 25/024* (2013.01); *A47B 96/07* (2013.01); *F25D 25/027* (2013.01)

(58) Field of Classification Search
CPC ..... A47B 49/004; A47B 77/10; A47B 96/025; A47B 81/002; A47B 96/07; A47B 96/04;
(Continued)

(56) References Cited

U.S. PATENT DOCUMENTS 535,886 A * 3/1895 Brand ..... F04D 25/08 5/173
2,316,408 A * 4/1943 Dawson ..... F16H 25/14 74/55

(Continued)

FOREIGN PATENT DOCUMENTS

DE 1198026 B 8/1965
DE 4216765 A1 12/1992

(Continued)

OTHER PUBLICATIONS

International Search Report dated Nov. 13, 2018 in related/corresponding International Application No. PCT/EP2018/072994.

(Continued)

*Primary Examiner* — Hanh V Tran
(74) *Attorney, Agent, or Firm* — Patent Portfolio Builders PLLC

(57) ABSTRACT

A storage shelf base for an item of furniture or household appliance, includes a support plate arranged on a body of the item of furniture or household appliance, and a storage shelf positively driven relative to the support plate and can simultaneously be moved rotationally and traslationally. Facing bearing surfaces of the support plate and the storage shelf have respective closed circulating running grooves, in which rolling elements are guided. The storage shelf can be moved out of an initial position into an intermediate position, relative to the support plate in an opening movement, in which the storage shelf is rotated relative to the support plate in a rotational direction and shifted in a predetermined direction and can be moved out of the intermediate position back into the initial position in a closing movement. The facing bearing surfaces of the support plate and the storage shelf have respective second running grooves, in which rolling elements are guided. The second running grooves of (Continued)

Figure 1:
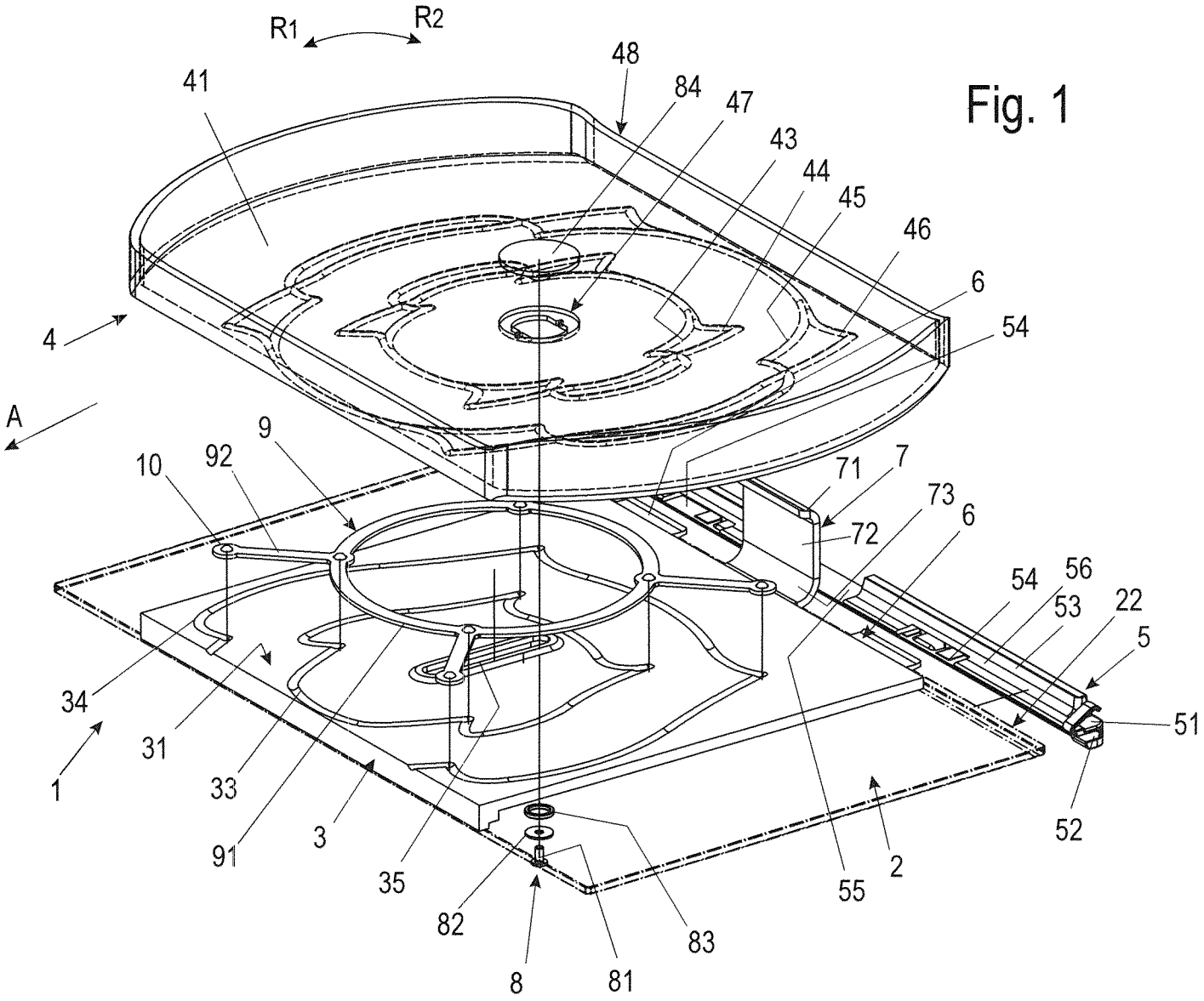

the support plate and the storage shelf at least partially surround the first running grooves of the support plate and the storage shelf.

18 Claims, 6 Drawing Sheets

(58) Field of Classification Search
CPC ..... A47B 37/00; A47B 96/027; A47B 83/045; A47B 2037/005; F25D 25/024; F25D 25/027
See application file for complete search history.

(56) References Cited

U.S. PATENT DOCUMENTS 2,540,125 A * 2/1951 Kolks ..... F16C 29/04 74/55
2,647,812 A * 8/1953 Saunders ..... F25D 25/027 312/294
2,840,438 A * 6/1958 Sharpe ..... F25D 25/027 312/322
2,936,205 A * 5/1960 Clark ..... F25D 25/027 312/302
3,107,959 A * 10/1963 Maxwell, Jr. ..... F25D 25/02 312/322
4,124,262 A * 11/1978 Schill ..... A47B 49/004 16/378
4,191,437 A * 3/1980 Funke ..... A47B 49/00 108/94
4,392,628 A * 7/1983 Hadfield ..... A47B 49/004 211/144
4,485,997 A * 12/1984 Potter ..... A47B 49/00 211/163
4,582,372 A * 4/1986 Cooper ..... A47B 46/00 108/140
5,138,743 A * 8/1992 Hoffman ..... E05F 1/1223 16/303
5,143,013 A * 9/1992 Huebner ..... B63B 29/04 114/343
6,322,679 B1 * 11/2001 De Bosscher ..... H01J 37/3408 204/192.12
6,585,119 B2 * 7/2003 Palder ..... A47F 5/02 211/163
7,147,445 B2 * 12/2006 Krayer ..... F16N 13/20 418/150
9,022,495 B1 * 5/2015 Conner, Sr. ..... F25D 25/027 312/408
9,052,134 B1 * 6/2015 Batchler ..... F25D 25/02
9,528,753 B1 * 12/2016 Conner, Sr. ..... A47F 3/08
2002/0117943 A1 * 8/2002 Gerkey ..... A47B 49/006 312/238
2005/0196310 A1 * 9/2005 Krayer ..... A47B 81/002 418/61.3
2009/0079305 A1 * 3/2009 Hirayoshi ..... A47B 46/00 312/209
2010/0129184 A1 * 5/2010 Thogersen ..... B62D 63/06 414/467
2010/0176074 A1 * 7/2010 Andersen ..... A47F 5/0087 211/59.2
2017/0184335 A1 * 6/2017 Jeon ..... F25D 23/04
2020/0018349 A1 * 1/2020 Rehage ..... A47B 96/025
2020/0170408 A1 * 6/2020 Rehage ..... A47B 96/025
2020/0187641 A1 * 6/2020 Rehage ..... A47B 49/004
2020/0191471 A1 * 6/2020 Rehage ..... F25D 25/027

FOREIGN PATENT DOCUMENTS

DE 202004009955 U1 12/2004
DE 102017106170 A1 9/2018
EP 3159635 A1 4/2017

OTHER PUBLICATIONS

Written Opinion dated Nov. 13, 2018 in related/corresponding International Application No. PCT/EP2018/072994.
Search Report dated Jun. 2, 2020 in related/corresponding DE Application No. 10 2017 120 159.9 (references from Search Report not cited herewith have previously been made of record).

* cited by examiner

STORAGE SHELF BASE AND ITEM OF FURNITURE OR HOUSEHOLD APPLIANCE

BACKGROUND AND SUMMARY OF THE INVENTION

Exemplary embodiments of the present invention relate to a storage shelf base for an item of furniture or household appliance and an item of furniture or household appliance.

Storage shelf bases of this type, in which a support plate and a storage shelf guided on the support plate are arranged so that they can be moved simultaneously in rotation and in translation, allow access to otherwise inaccessible surfaces in the storage space of an item of furniture or household appliance such as a refrigerator or freezer.

For example, DE 42 16 765 A1 discloses storage shelf bases equipped with a turntable where the turntable is installed directly in the base plate of the storage shelf base).

The post-published DE 10 2017 106 170 A1 discloses a storage shelf that is positively guided relative to the support plate and can be moved simultaneously in rotation and translation.

The disadvantage of these prior art storage shelf bases is that the load on the rotating bearing of the shelf is very uneven, especially when the load on the shelf is unevenly distributed. This can result in one of the rolling elements forming a temporary fulcrum due to high frictional forces, which is not congruent with the instantaneous pole of the motion control and can therefore sometimes lead to jamming of the bearing.

Exemplary embodiments of the present invention are directed to a storage shelf base for an item of furniture or household appliance, which enables reliable operation of the storage shelf base even with unequally distributed loads.

The storage shelf base according to the invention has a support plate arranged on the body of the furniture or household appliance and a storage plate, which is positively guided relative to the support plate and can be moved simultaneously in rotation and translation.

The bearing surfaces of the support plate and the storage shelf facing each other have respective closed, circumferential first running grooves in which the rolling elements are guided.

The storage shelf can be moved relative to the support plate in an opening movement from an initial position to an intermediate position, in which the shelf is rotated relative to the support plate in one direction of rotation and displaced in a predetermined direction and can be moved in a closing movement from the intermediate position back to the initial position or further in one direction of rotation to a position rotated through 180° to the initial position.

The storage shelf is rotatable relative to the support plate in a first direction of rotation and in an opposite second direction of rotation, which further simplifies the operability of the device.

A further simplification of the operability of the device is achieved in that the storage shelf can be rotated at any angle relative to the support plate in a first direction of rotation and in an opposite second direction of rotation.

The mutually facing bearing surfaces of the support plate and the storage shelf have respective second running grooves in which rolling elements are guided, wherein the second running grooves of the support plate and the storage shelf at least partially enclose the first running grooves of the support plate and the storage shelf.

By introducing the second running grooves into the bearing surfaces of the support plate and the storage shelf, a more even force distribution is possible even with asymmetrical loading. This significantly reduces frictional forces in the bearing arrangement. In particular, the surface pressure of the rolling elements can be reduced by up to 50%, especially in the static state.

In addition, the danger of undefined movements, especially in the starting phase of the movement of the storage shelf relative to the support plate, is clearly limited by the larger radii of the second running grooves.

In accordance with an advantageous embodiment variant, the second running grooves formed in the bearing surface of the storage shelf are designed as closed, circumferential running grooves, which enables reliable guidance of the rolling elements.

According to another embodiment variant, the outer running groove integrally formed in the bearing surface of the support plate is formed open towards one side, in particular the front side of the support plate, which facilitates the installation of the storage shelf base.

In order to optimize the running-off and running-down of the rolling elements from or onto the support plate, the outer running groove towards the front side of the support plate is designed as a lead-in region, in particular as a lead-in chamfer, wherein a rounded transition can additionally be provided in the transition from the lead-in chamfer to the actual running groove profile, which is designed complementary to the rolling element profile. Instead of the lead-in chamfer, there may also be a lead-in rounding.

The rolling elements are accommodated in at least one rolling element cage according to another preferred embodiment variant.

The rolling elements of the first running grooves and the second running grooves are particularly preferably accommodated in a common rolling element cage, which also facilitates and accelerates the assembly of the storage shelf base.

The rolling element cage has a circular ring and four arms extending radially from the circular ring in a preferred embodiment variant, which enables optimized load distribution to the individual rolling elements with reduced material input.

According to an advantageous embodiment variant, the rolling elements are accommodated in receiving pockets formed in the area of the free ends of the arms and in the circular ring in the area of the connection of the arms to the circular ring.

In order to achieve the largest possible load distribution, the length of the arms is preferably greater than half the radius of the circular ring.

The bearing surfaces of the storage shelf or support plate are designed integrally with the support plate or storage shelf in accordance with an embodiment variant of the invention. In an alternative embodiment variant, at least one of the bearing surfaces is designed as a separate element that can be inserted into an appropriately shaped receptacle in the support plate or storage shelf or which can be attached to the support plate or storage shelf by connecting means.

For improved positioning of the storage shelf in the basic position, the at least predominantly closed circumferential running grooves preferably have several locking points for the rolling elements at least in the initial position and/or in a position rotated by 180° to the initial position.

In accordance with another advantageous embodiment variant of the invention, a tilting protection element is arranged on the support plate that overlaps the upper edge of the storage shelf and serves to prevent a tilting movement of the storage shelf around a tilting axis parallel to the shelf surface. Alternatively, the tilting protection element can be designed in such a way that it engages in a groove in the shelf.

The advantage of such a tilting protection element is the prevention of a tilting movement of the storage shelf, especially when the load on the storage shelf is unevenly distributed with objects placed on the storage shelf.

According to a preferred embodiment variant, a section of the tilting protection element is located in a second recess of the base plate holder, whereby an additional stabilization of the tilting protection element is achieved. The tilting protection element is designed as a catch hook, in particular formed in a C-shaped manner, according to a preferred embodiment variant.

BRIEF DESCRIPTION OF THE DRAWING FIGURES

Figure 2:
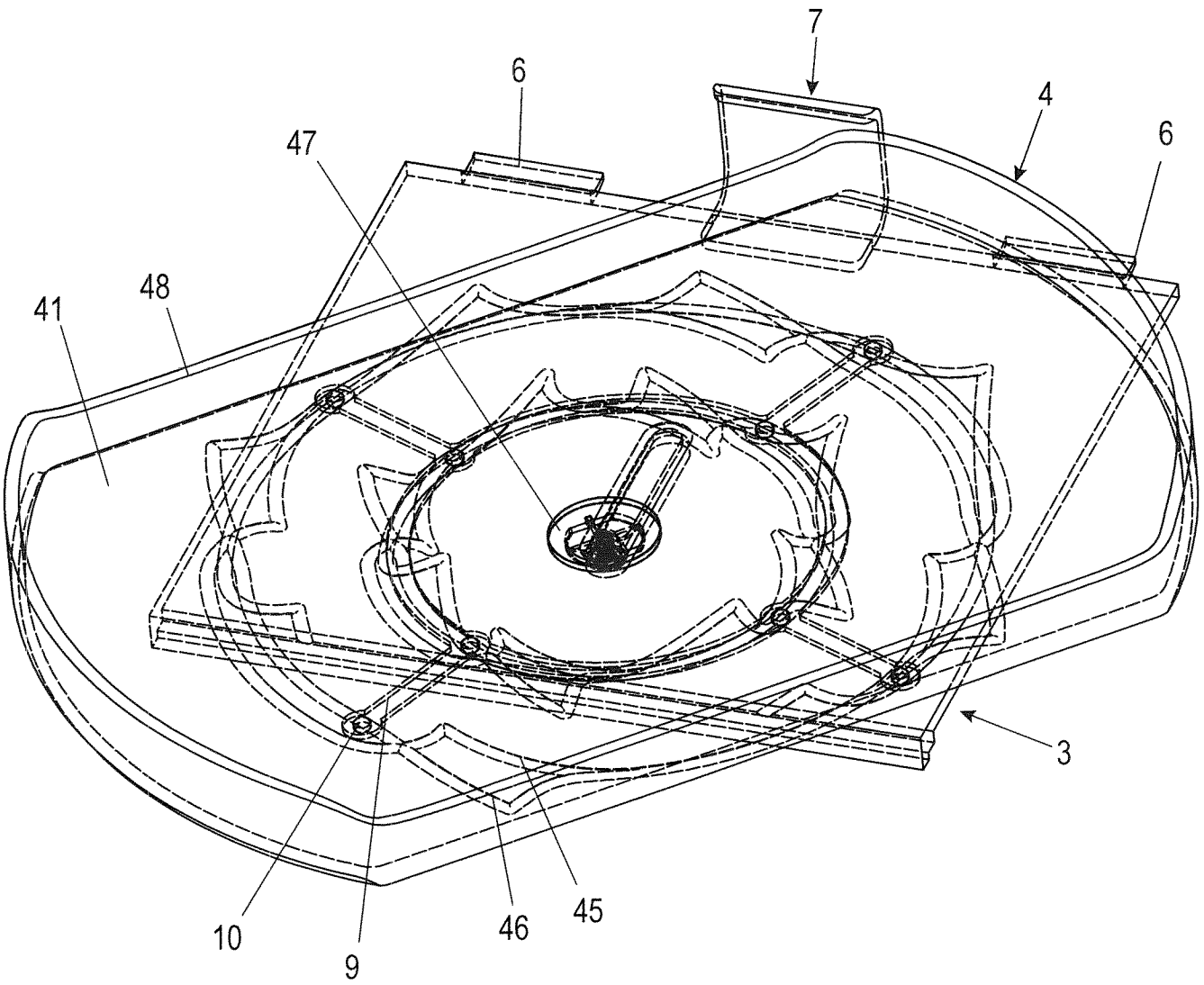
Figure 3:
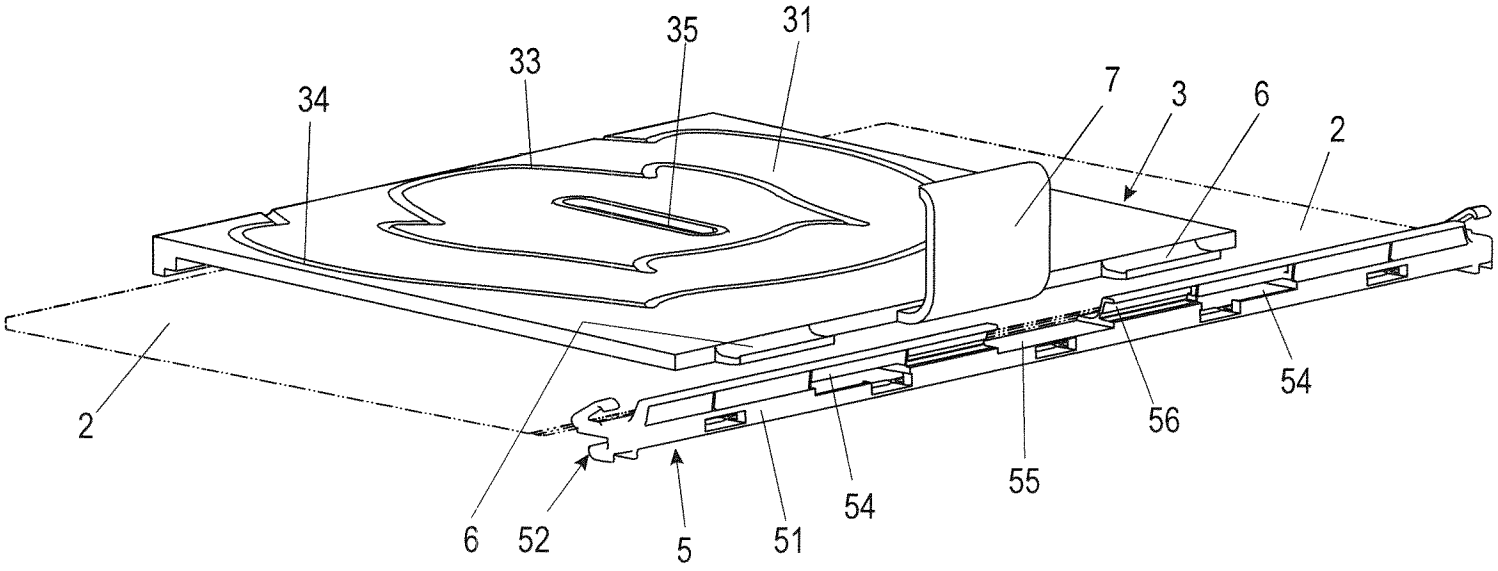
Figure 4:
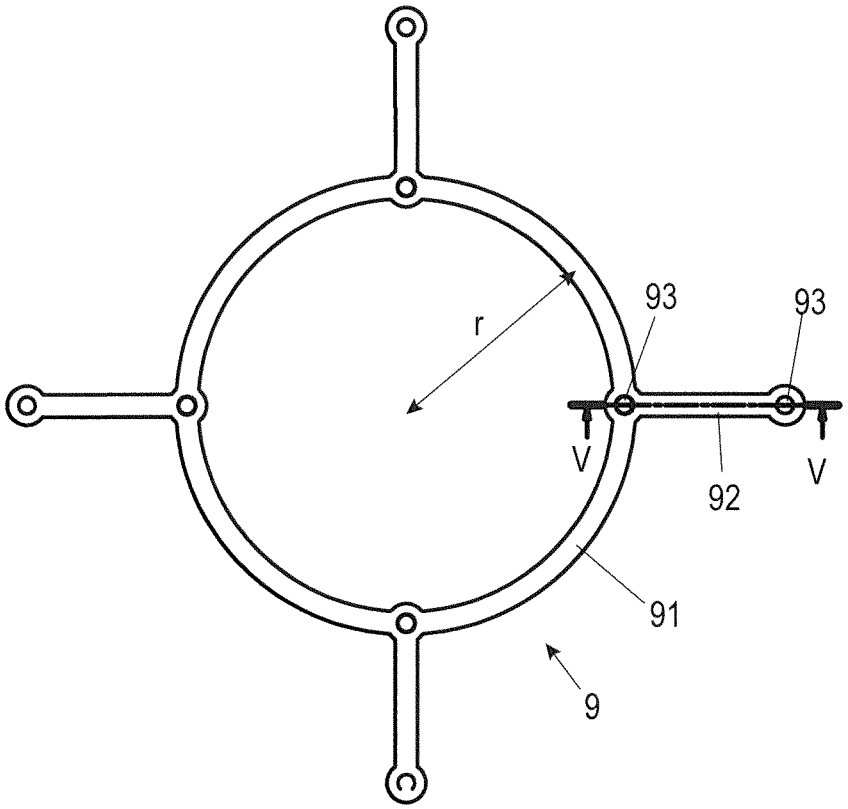
Figure 5:
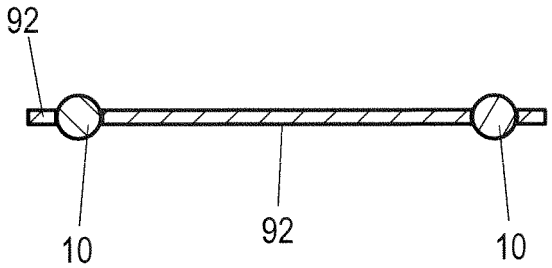
Figure 6:
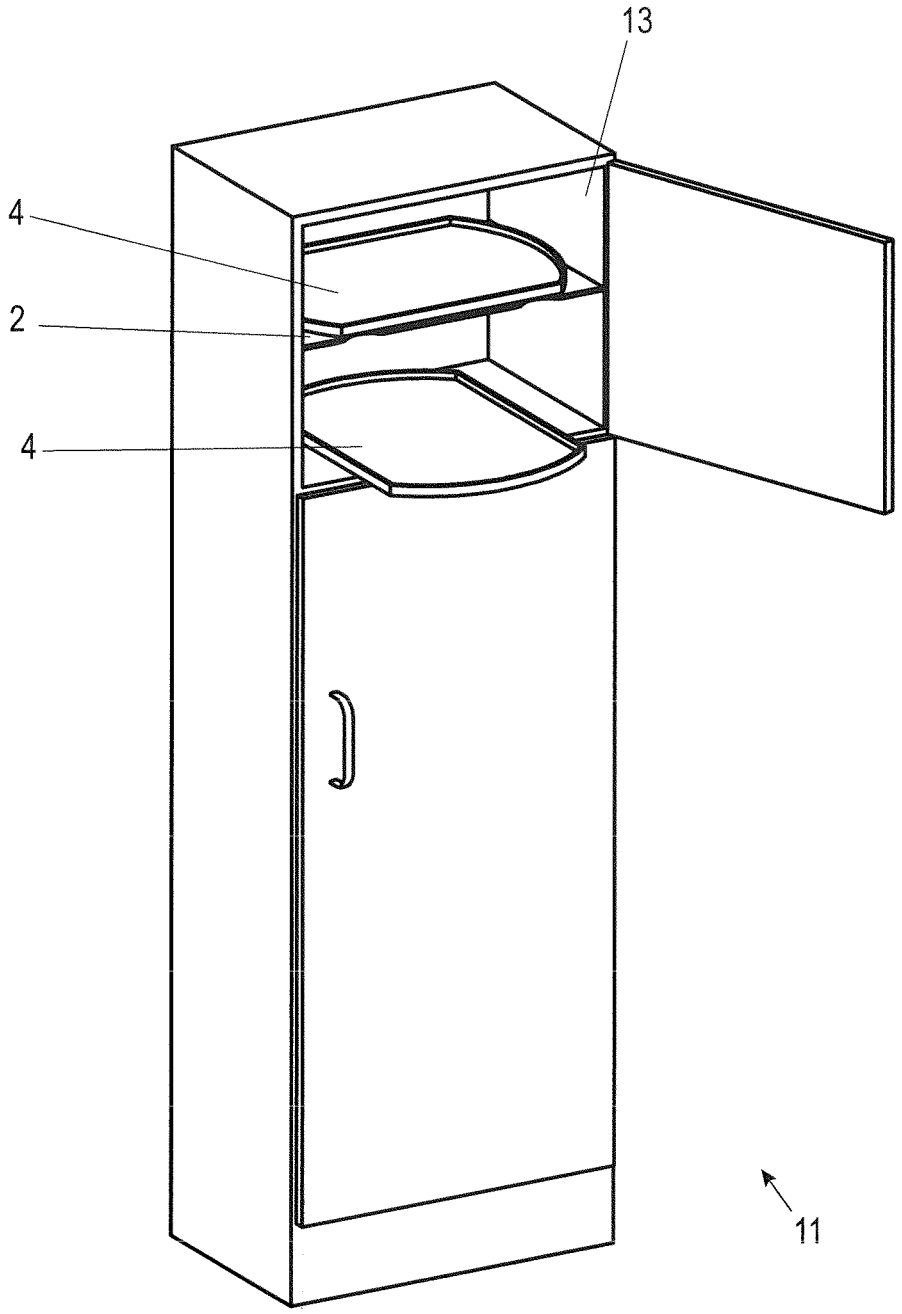
Figure 7:
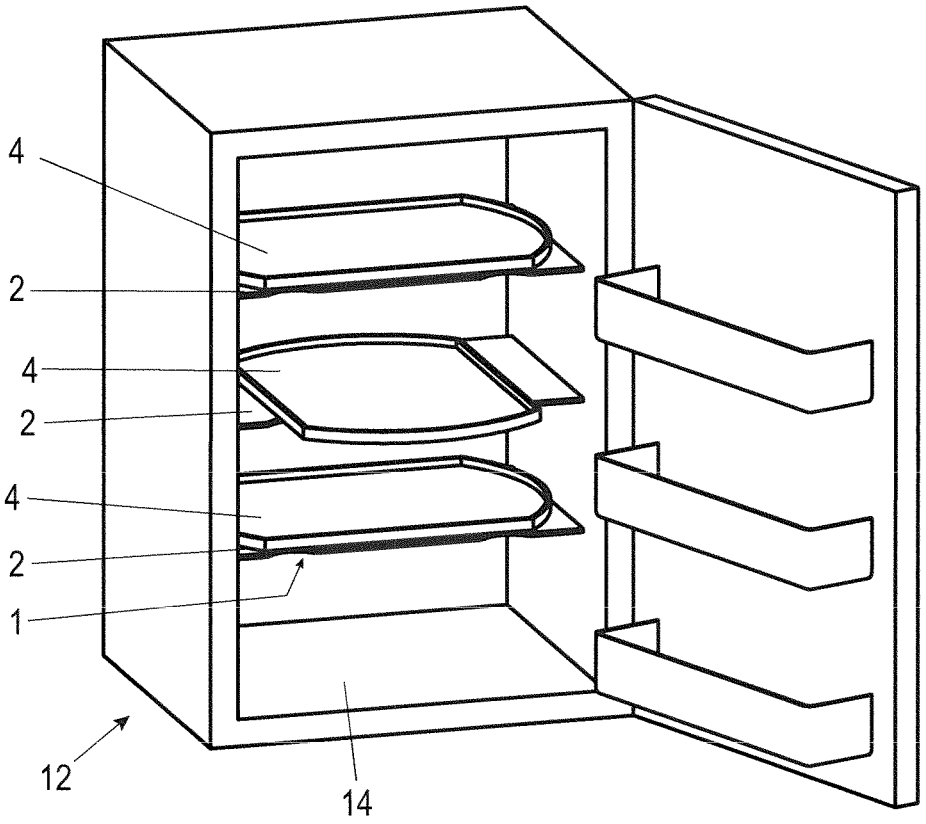

In the following, preferred embodiment examples of the invention are explained in more detail using the enclosed drawings, wherein:

FIG. 1 shows a perspective exploded view of an embodiment variant of a storage shelf according to the invention, FIG. 2 shows a schematic perspective view of the storage shelf base according to FIG. 1 in a position of the storage shelf rotated by 45° relative to the support plate, FIG. 3 shows a perspective view of the base plate, the support plate and the base plate holder in an exploded view, FIG. 4 shows a top view of a rolling element cage for accommodating the rolling elements, FIG. 5 shows a sectional view of the section marked V in FIG. 4 to show part of the rolling element cage, FIG. 6 shows a perspective view of an item of furniture with storage shelf bases built into it, and FIG. 7 shows a perspective view of a household appliance designed as a refrigerating appliance with storage shelf bases built into it.

DETAILED DESCRIPTION

In the following figure description, terms such as top, bottom, left, right, front, back, etc. refer exclusively to the exemplary representation and position of the storage shelf base, base plate, support plate, storage shelf, running grooves, etc. selected in the respective figures. These terms are not to be understood restrictively, i.e. these references can change due to different working positions or the mirror-symmetrical interpretation or the like.

In FIG. 1, the reference numeral 1 denotes a storage shelf base as a whole.

In this embodiment variant, storage shelf base 1 has a base plate 2, which can be fixed in a stationary manner to a body 13, 14 of an item of furniture 11 or household appliance 12 (shown in FIGS. 6 and 7) and a support plate 3, which is arranged on base plate 2.

On this support plate 3 there is a storage shelf 4, which can be moved simultaneously in rotation and in translation. For positively guided simultaneous rotational and translational movement, mutually facing bearing surfaces 31, 42 of support plate 3 and support 4 have respective closed, circumferential first running grooves 33, 43, 44 in which rolling elements 10 are guided. The rolling elements 10 used here are in particular balls.

The support plate 3 is detachably fastened to the base plate 2 or, as shown in FIG. 1, to a base plate holder 5, which fixes the base plate 2 to the body of the furniture or household appliance.

Alternatively, the support plate 3 can be attached directly, preferably detachably, to body 13, 14 of the item of furniture 11 or household appliance 12 via one or more adapters. In this case, no additional base plate 2 is necessary or the support plate 3 with the storage shelf 4 replaces the base plate 2.

As shown in FIGS. 1 and 2, first inner running grooves 33, 43, 44 and, for improved support of the storage shelf 4, second outer running grooves 34, 45, 46 are provided both on the upper side or bearing surface 31 of the support plate 3 facing the storage shelf 4 and on the lower side or bearing surface of the storage shelf 4 facing the support plate 3.

The inner running groove 33 of support plate 3 is designed as a closed circumferential running groove. The outer running groove 34 is open towards a front side of storage shelf base 1.

The outer running groove 34 is preferably designed as a lead-in chamfer towards the front of the support plate 3 in order to facilitate the lead-in and run-down of the rolling elements 10 from or onto the support plate 3, wherein a rounded transition can additionally be provided in the transition from the lead-in chamfer to the actual running groove profile, which is designed complementary to the rolling element profile.

For positively guided simultaneous rotational and translational movement of storage shelf 4, two partially overlapping inner running grooves 43, 44 and two likewise partially overlapping outer running grooves 45, 46 are each inserted into the underside of storage shelf 4. All running grooves 43, 44, 45, 46 are designed as closed circumferential running grooves.

FIG. 2 shows the storage shelf base 1 in a 45° rotated position. As can be seen here, one of the rolling elements 10 is arranged outside the surface of the support plate 3.

To prevent the loss of this rolling element 10, the rolling elements 10 are accommodated in a rolling element cage 9. A preferred embodiment variant of such a rolling element cage 9 is shown in FIG. 4.

The rolling element cage 9 here is in the form of a circular ring 91 with four arm-shaped extension arms 92 extending radially outwards from the circular ring 91, at each of whose free end a further rolling element 10 is accommodated.

It is also conceivable, for example, to design the rolling element cage 9 with only two extension arms 92 or a different number of extension arms 92.

Other designs of the extension arms are also conceivable, for example in the form of V-shaped extension arms.

Four rolling elements 10 are preferably arranged between the first running grooves 33, 43 and 44. Four rolling elements 10 are also preferably arranged between the second, outer running grooves 34, 45, 46. If the rolling element cage 9 is designed with only two extension arms 92, only two rolling elements 10 can be arranged in each case in the inner and outer running grooves.

The rolling elements 10 of the first running grooves 33, 43, 44 and the second running grooves 34, 45, 46 are preferably accommodated in a common rolling element cage 9, as shown in FIG. 4.

It is also conceivable to provide separate rolling element cages for rolling elements 10 of the first inner running grooves 33, 43, 44 and rolling elements 10 of the second outer running grooves 34, 45, 46.

To accommodate the rolling elements 10, receiving pockets 93 are preferably formed in the area of the free ends of the extension arms 92 and in the circular ring 91 in the area of the connection of the extension arms 92 to the circular ring 91. These receiving pockets 93 hold the rolling elements, which are designed here as balls, in a stationary manner in the rolling element cage 9.

A staggered arrangement of the receiving pockets 93 is also conceivable, in which the receiving pockets 93 of the circular ring 91 are not arranged radially to the receiving pockets 93 of the extension arms 92.

The length of the extension arms 92 is preferably greater than half the radius r of the circular ring 91 in order to optimize the load distribution to the individual rolling elements 10.

Both the inner running grooves 33, 43, 44 and the outer running grooves 34, 45, 46 are shaped in such a way that, when force is applied to the storage shelf 4 in the horizontal direction, the storage shelf 4 can be moved from an initial point in accordance with the orientation of the storage shelf 4 shown in FIG. 1 relative to the support plate 3 via an intermediate position shown in FIG. 2 into a loading or unloading position rotated through 90°, in which the storage shelf 4 is not only rotated through 90° but is also displaced through a predetermined distance in order to facilitate loading and unloading.

The movement back to the initial position is equally simple by exerting force in the horizontal direction in the closing direction, in which the storage shelf 4 is moved further into the closing position while maintaining the initial direction of rotation, or by reversing the direction of rotation.

As shown in FIGS. 1 and 3, the base plate holder 5 for holding the base plate 2 at least partially engages around an edge 22 of the base plate 2.

For this purpose, the base plate holder 5 has two recesses 54, into which a respective connecting element 6 extending from one edge of the support plate 3 can be inserted and which are held in the inserted state in the base plate holder 5 by positive or frictional locking.

As shown in FIGS. 1 and 3, the connecting element 6 is integrally formed on the support plate 3. The connecting element 6 here is designed as a tongue-like web, with a hook thickening upwards or bent upwards at its free end, which engages behind a strip section 56 of the base plate holder 5.

The base plate holder 5 essentially consists of a strip-shaped base body 51 with a slot 52 extending over the longitudinal extension of the base body 51, which serves to accommodate a rear edge 22 of the base plate 2.

A fastening strip 53 is integrally formed above slot 52, which serves to fasten the base plate holder 5 to the body 13, 14 of the item of furniture 11 or the household appliance 12 and with which the base plate 2 can be fixed to the body 13, 14 of the item of furniture 11 or household appliance 12, here in the form of a refrigerating appliance.

One or more first recesses 54 are introduced into this fastening strip 53, the one or more first recesses 54 are used to accommodate the connecting element 6.

As shown in FIGS. 1 and 3, the base plate holder 5 has a second recess 55 above the slot 52, which serves to accommodate a tilting protection element 7.

Such a tilting protection element 7 is also arranged on the support plate 3 and shaped in such a way that it overlaps an upper edge 48 of the storage shelf 4.

The tilting protection element 7 serves to prevent a tilting movement of the storage shelf 4 around a tilting axis parallel to the shelf surface 41 of the shelf 4. Such a tilting movement can occur, in particular, when loads are distributed unevenly on shelf surface 41 of storage shelf 4.

The tilting protection element 7 is preferably designed as a C-shaped catch hook, wherein a section 73 of the tilting protection element 7 protrudes from the rear edge of the support plate 3 and is bent upwards. A flat central section 72 adjoins this section 73, wherein its height extension is adapted to the vertical height of a wall surrounding the shelf surface 41 of the storage shelf 4, with a bent end 71 of the tilting protection element 7 adjoining the central section 72 projecting beyond its upper edge 48 and, in the event of a tilting movement, prevents the storage shelf 4 from tilting.

It is also conceivable to arrange retaining elements on the support plate 3 itself, in particular to form them integrally, which retaining elements engage around the base plate 2 and thus allow the support plate 3 to be fixed to the base plate 2.

The support plate 3 and the storage shelf 4 are fixed to each other for axial fixing by means of a fixing device 8.

As shown in FIG. 1, the fixing device 8 has a screw 81, which protrudes from below through a slot 35 in the support plate 3, thus enabling a displacement movement of the storage shelf 4 relative to the support plate 3.

In order to enable a low-friction displacement movement, a washer 82 and a sliding ring 83 are placed on screw 81, which is in contact with the underside of the support plate 3 facing the base plate 2 in the area of slot 35.

For axial fixing to the storage shelf 4, a mounting bracket 47 is inserted into the shelf surface 41 of the shelf 4, which is covered by a cap 84.

The underside of this cap 84 facing screw 81 is provided with a screw hole with an internal thread into which screw 81 can be screwed, thus holding the cap 84 axially in its mounting position.

The base plate 2 can be designed as a glass plate. It is also possible to design a base plate 2 as a wooden plate or a plate made of plastic or metal. The support plate 3 and the storage shelf 4 are preferably made of plastic or glass.

It is particularly advantageous that, for example, in the case of a household appliance designed as a refrigerating device, such as in particular a refrigerator or freezer, an already existing base plate 2, for example in the form of a glass plate, can be used to stabilize and retrofit the support plate and the storage shelf to create a storage shelf base 1, which can be moved simultaneously by translation and rotation and is therefore particularly easy to load or unload.

FIG. 6 shows the storage shelf bases according to the invention in an item of furniture 11, wherein the item of furniture 11 has a body 13 in which the storage shelf bases 1 are arranged.

FIG. 7 shows storage shelf bases according to the invention in a household appliance, in this case a refrigerator, 12, wherein the household appliance 12 has a body 14 in which the storage shelf bases 1 are arranged.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Storage shelf base
2 Base plate
22 Edge
3 Support plate
31 Bearing surface
32 Underside
33 Running groove
34 Running groove
35 Slot
4 Storage shelf
41 Shelf surface
43 Running groove
44 Running groove
45 Running groove
46 Running groove
47 Mounting bracket
48 Upper edge
5 Base plate holder
51 Base body
52 Slot
53 Fastening strip
54 First recess
55 Second recess
56 Strip section
6 Connecting element
7 Tilting protection element
71 Bent end
72 Central section
73 Section
8 Fixing device
81 Screw
82 Washer
83 Sliding ring
84 Cap
9 Rolling element cage
91 Circular ring
92 Extension arm
93 Receiving pocket
10 Rolling elements
11 Item of furniture
12 Household appliance
13 Body
14 Body
r Radius
A Direction
$R_1$ Direction of rotation
$R_2$ Direction of rotation

The invention claimed is:

1. A storage shelf for an item of furniture or household appliance, the storage shelf comprising:

a support plate arranged on a body of the item of furniture or household appliance; and a storage shelf, which is positively guided relative to the support plate and simultaneously movable in rotation and translation, wherein mutually facing bearing surfaces of the support plate and of the storage shelf have respective at least predominantly closed, circumferential first running grooves in which first rolling elements are guided, wherein the storage shelf is movable relative to the support plate in an opening movement from an initial position into an intermediate position, in which the storage shelf is rotated relative to the support plate in a direction of rotation and displaced in a predetermined direction and is movable in a closing movement from the intermediate position back into the initial position or further into the one direction of rotation into a position rotated through 180° to the initial position, wherein the mutually facing bearing surfaces of the support plate and of the storage shelf have respective second running grooves in which second rolling elements are guided, wherein the second running grooves of the support plate and of the storage shelf at least partially enclose the first running grooves of the support plate and of the storage shelf.

2. The storage shelf base of claim 1, wherein the second running grooves integrally formed in the bearing surface of the storage shelf are closed circumferential running grooves.

3. The storage shelf base of claim 2, wherein the second running groove integrally formed in the bearing surface of the support plate is open towards one side of the support plate.

4. The storage shelf base of claim 3, wherein the second running groove integrally formed in the bearing surface of the support plate, towards the one side of the support plate, is an inlet region having a lead-in chamfer or a rounding.

5. The storage shelf base of claim 1, wherein the first and second rolling elements are accommodated in at least one rolling element cage.

6. The storage shelf base of claim 1, wherein the first rolling elements comprise four rolling element spaced apart from each of and arranged between the first running grooves in the mutually bearing surfaces of the support plate and of the storage shelf.

7. The storage shelf base of claim 1, wherein the second rolling elements comprise four rolling element spaced apart from each of and arranged between the second running grooves in the mutually bearing surfaces of the support plate and of the storage shelf.

8. The storage shelf base of claim 1, wherein the first and second rolling elements are balls.

9. The storage shelf base of claim 1, wherein the first and second rolling elements are accommodated in a common rolling element cage.

10. The storage shelf base of claim 9, wherein the common rolling element cage has a circular ring and a plurality of extension arms extending from the circular ring.

11. The storage shelf base of claim 10, wherein the plurality of extension arms comprise at least two arm-shaped extension arms extending radially from the circular ring.

12. The storage shelf base of claim 10, wherein receiving pockets for receiving the first and second rolling elements are formed in a region of free ends of the extension arms and in the circular ring in a region of a connection of the plurality of extension arms to the circular ring.

13. The storage shelf base of claim 10, wherein a length of the plurality of extension arms is greater than half a radius of the circular ring.

14. The storage shelf base of claim 1, further comprising:

a tilting protection element, which engages over an upper edge of the storage shelf or engages in a groove of the storage shelf, wherein the tilting protection element is arranged on the support plate to prevent a tilting movement of the storage shelf about a tilting axis parallel to a shelf surface of the storage shelf.

15. The storage shelf base of claim 14, wherein the tilting protection element is a catch hook.

16. The storage shelf base of claim 1, further comprising:

a base plate fastened in a stationary manner to the body of the item of furniture or household appliance, wherein the support plate is arranged on the base plate.

17. An item of furniture, comprising:

a body; and at least one storage shelf base arranged in the body, wherein the at least one storage shelf base comprises a support plate arranged on the body of the item of furniture or household appliance; and a storage shelf, which is positively guided relative to the support plate and simultaneously movable in rotation and translation, wherein mutually facing bearing surfaces of the support plate and of the storage shelf have respective at least predominantly closed, circumferential first running grooves in which first rolling elements are guided, wherein the storage shelf is movable relative to the support plate in an opening movement from an initial position into an intermediate position, in which the storage shelf is rotated relative to the support plate in a direction of rotation and displaced in a predetermined direction and is movable in a closing movement from the intermediate position back into the initial position or further into the one direction of rotation into a position rotated through 180° to the initial position, wherein the mutually facing bearing surfaces of the support plate and of the storage shelf have respective second running grooves in which second rolling elements are guided, wherein the second running grooves of the support plate and of the storage shelf at least partially enclose the first running grooves of the support plate and of the storage shelf.

18. A refrigerator or freezer, comprising:

a body; and at least one storage shelf base arranged in the body, wherein the at least one storage shelf base comprises a support plate arranged on the body of the refrigerator or freezer; and a storage shelf, which is positively guided relative to the support plate and simultaneously movable in rotation and translation, wherein mutually facing bearing surfaces of the support plate and of the storage shelf have respective at least predominantly closed, circumferential first running grooves in which first rolling elements are guided, wherein the storage shelf is movable relative to the support plate in an opening movement from an initial position into an intermediate position, in which the storage shelf is rotated relative to the support plate in a direction of rotation and displaced in a predetermined direction and is movable in a closing movement from the intermediate position back into the initial position or further into the one direction of rotation into a position rotated through 180° to the initial position, wherein the mutually facing bearing surfaces of the support plate and of the storage shelf have respective second running grooves in which second rolling elements are guided, wherein the second running grooves of the support plate and of the storage shelf at least partially enclose the first running grooves of the support plate and of the storage shelf.

* * * * *